US005782620A

United States Patent [19]

Nothdurft et al.

[11] Patent Number: 5,782,620

[45] Date of Patent: Jul. 21, 1998

[54] FUEL INJECTION PUMP FOR INTERNAL COMBUSTION ENGINES

[75] Inventors: Heinz Nothdurft; Wolfgang Fehlmann; Bernhard Bonse; Nestor Rodriguez-Amaya; Ewald Eblen, all of Stuttgart; Holger Pitsch, St. Ingbert; Andreas Sterr, Nuertingen; Walter Fuchs, Stuttgart; Andreas Dutt, Stuttgart; Joerg Wolke, Stuttgart, all of Germany

[73] Assignee: Robert Bosch GmbH, Stuttgart, Germany

[21] Appl. No.: 751,094

[22] Filed: Nov. 15, 1996

[30] Foreign Application Priority Data

Nov. 18, 1995 [DE] Germany ..... 195 42 952.4

[51] Int. Cl.[6] ..... F04B 27/06

[52] U.S. Cl. ..... 417/462; 123/450

[58] Field of Search ..... 123/450; 417/500, 417/462

[56] References Cited

U.S. PATENT DOCUMENTS

| | | | |
|---|---|---|---|
| 4,165,725 | 8/1979 | George et al. | 123/139 AL |
| 4,426,977 | 1/1984 | Taplin et al. | 123/446 |
| 5,207,201 | 5/1993 | Schlagmuller . | |
| 5,582,153 | 12/1996 | Dutt et al. | 123/450 |
| 5,619,971 | 4/1997 | Kubo et al. | 123/450 |

FOREIGN PATENT DOCUMENTS

| | | |
|---|---|---|
| 0023467 | 2/1981 | European Pat. Off. . |
| 2449332 | 8/1986 | Germany . |
| 540616 | 10/1941 | United Kingdom . |
| 1508234 | 4/1978 | United Kingdom . |
| 1577954 | 10/1980 | United Kingdom . |
| WO 85/04449 | 10/1985 | WIPO . |

*Primary Examiner*—Timothy Thorpe
*Assistant Examiner*—Peter G. Korytnyk
*Attorney, Agent, or Firm*—Edwin E. Greigg; Ronald E. Greigg

[57] ABSTRACT

A fuel injection pump for internal combustion engines which has a moving part supported in a housing bore and on its jacket face on one side, has an exit opening that is under high pressure, and whose bearing is improved by virtue of the fact that on the jacket face of the part or in the wall of the housing bore, at least one pressure compensation is provided. The compensation face is connected to a high pressure source, is disposed on a side of the jacket face of the part which side is remote from the exit opening, and is continuously covered by the wall of the housing bore. As a result, a compensation of the pressure action by means of the pressure field prevailing in the region of the exit opening occurs so that an improved, less damage-prone bearing is produced with a greater high pressure tightness of the moving part.

2 Claims, 1 Drawing Sheet

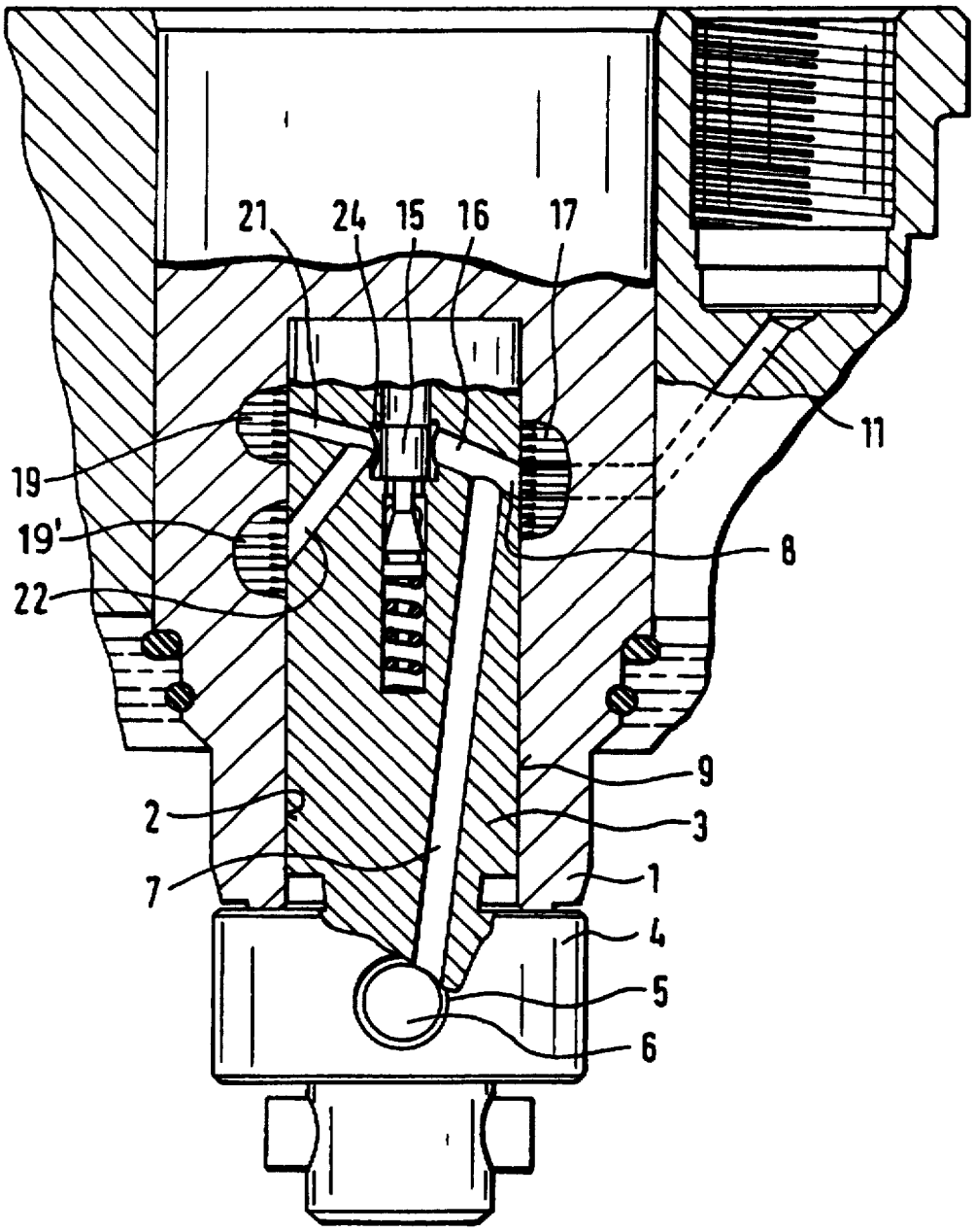
21
24
15
16
17
11
19
19'
8
22
9
2
3
7
1
4
5
6

FUEL INJECTION PUMP FOR INTERNAL COMBUSTION ENGINES

BACKGROUND OF THE INVENTION

The invention relates to a fuel injection pump for internal combustion engines. DE-C-24 49 332 discloses a fuel injection pump of this generic type, which has a pump piston that is driven to reciprocate in the housing bore and at the same time is also driven to rotate and with its distributor opening, is also used as a distributor. In this known fuel injection pump, another longitudinal groove is disposed on the jacket face of the pump piston, possibly disposed opposite the distributor opening, which groove continuously communicates with the fuel that is supplied under high pressure to the distributor opening. With an embodiment of this kind, a pressure application, possibly disposed diametrically opposite the distributor openings, is produced between a pump piston and a housing bore in such a way that the pump piston is evenly loaded by the compression forces and the tendency for the piston to score the inside of the housing bore is prevented. This additional groove regularly comes into connection with injection lines that do not participate in the injection and carries out a pressure compensation between these lines with an injection line opened at the same time by the distributor opening in an intake phase of the pump piston.

This embodiment has the disadvantage that despite the fact that a force compensation is carried out on the pump piston, an interruption of the lubricating oil film occurs by means of the large-surfaced grooves in the jacket face of the distributor or pump piston, which film is intended to carry the pump piston in its rotation in the housing bore of the fuel injection pump.

OBJECT AND SUMMARY OF THE INVENTION

The fuel injection pump according to the invention has the advantage over the prior art that at least one pressure compensation face is effective in regions in which the wall of the housing bore is uninterrupted. In these regions, a lubricating film can consequently build up continuously by forming a lubricant wedge with the best carrying properties. The respective pressure compensation opening provided guides a sufficient amount of fuel into the gap between the jacket face of the moving part and the inner wall of the housing bore and builds up a pressure field there, similar to the one in the vicinity of the exit opening essentially on the opposite side of the jacket face. The pressure field produced in this manner consequently prevents a direct contact between the moving part and the wall of the housing bore since the jacket face of the moving part is now uniformly acted upon by forces, is uniformly supplied with compressed fuel for lubricating the moving part in the housing bore, and for these reasons, the bearing gap between the jacket face of the moving part and the wall of the housing bore can also be maintained at a constant thickness with regard to the circumference. On the whole, this leads to an increased high pressure tightness and a higher loading capacity of the fuel injection pump with regard to the magnitude of the injection pressures to be produced by it. As a result, the ability of such high pressures to be produced also leads to an optimization of the injection in such a way that the emission values of the affiliated internal combustion engine are reduced. In the end, the optimization of the bearing also permits the use of material pairings which are prone to scoring but have other advantages, since the optimal lubrication prevents this tendency toward being damaged.

Advantageous embodiments of the version disclosed are described hereinafter. The embodiment represents an advantageous use in a distributor fuel injection pump with a rotating distributor as a moving part. To improve the uniform loading of the moving part or of the distributor, a number of pressure compensation faces are advantageously provided, which are provided in particular on the end of the distributor remote from the distributor drive and the pump piston. By means of this, the effects of tilting moments transmitted to the distributor by the drive are reduced.

The invention will be better understood and further objects and advantages thereof will become more apparent from the ensuing detailed description of preferred embodiments taken in conjunction with the drawing.

BRIEF DESCRIPTION OF THE DRAWING

The FIGURE shows a partial section of a fuel distributor injection pump of the radial piston type.

DESCRIPTION OF THE PREFERRED EMBODIMENTS

In the fuel distributor injection pump shown in the FIGURE, a housing bore 2 is let into a housing 1 in the form of a blind bore or a bore that is closed on one end; a part that is embodied in the form of a distributor 3 is supported so that it can move, in this case, and rotate in this bore. On its end protruding from the housing bore 2, the distributor 3 has a collar 4 in which cylinder bores 5 are disposed, the cylinder bores run radial to the longitudinal axis of the distributor 3 in which pump pistons are guided, which in the inner part of the cylinder bores, enclose a common pump work chamber that serves as a high pressure source and is not shown in detail here. The pump pistons are driven to reciprocate in a sealed and sliding manner by means of intrinsically known cam means not shown in detail here, e.g. by means of an annular cam path on which rolling shoes slide that are each connected to a pump piston. The cam ring in this case is embodied as a fixed cam ring, while at the same time the distributor drive, which is not shown in detail, carries out the relative movement of the rolling shoes along the cam path via the rotating motion of the distributor and is consequently used to drive the pump piston. With the inward stroke of the pump piston, in the pump work chamber a fuel pressure is produced which is of the magnitude of the fuel injection pressure. The fuel is conveyed from the pump work chamber via a pressure line 7 in the distributor 3 to an exit opening in the form of a distributor opening 8 on the jacket face 9 of the distributor. In the region of the mouth of the distributor opening in the jacket face, injection lines 11 are provided in the housing 1, which lead from the housing bore 2 and each lead to a fuel injection valve, not shown in detail, in order to bring the fuel there, which has been brought to high pressure, to injection in the engine. Also, per association with the respective fuel injection line 11, the high fuel injection pressure exists only as long as a solenoid valve that controls injection time and injection quantity is closed; only the valve member 15 of this solenoid valve is shown here. Via this solenoid valve, a connecting line 16 is constituted from the distributor opening 8 to a relief chamber. Consequently when the valve is open, the fuel displaced by the pump piston 6 is supplied to the relief chamber in a more or less pressure free state, in any case at a pressure below the fuel injection pressure. Distributor fuel injection pumps of this type are known for example from DE-A1-43 39 948, U.S. application Ser. No. 08/454,357 filed Jun. 16, 1995, now U.S. Pat. No. 5,582,153, issued Dec. 10, 1996. Due to the one-sidedness of the position of the distributor opening on the jacket face 9 of the distributor 3 on the one hand and an intentional, very precise fit between distributor diameter and diameter of the housing bore 2 in order to produce a great high pressure tightness, brings about the disadvantage that in the borderline case, the rotationally driven distributor is no longer sufficiently supplied and lubricated with fuel inside the housing bore 2. This fuel enters into the gap between jacket face 9 and housing bore 2 as leakage fuel. In the borderline case, when there are high surface pressures, a sufficient lubricant wedge cannot be built up between the parts that are moved in relation to each other. A pressure field 17 is symbolically depicted in the drawing, in the region of the exit of the distributor opening 8.

To solve the above-described problem, now an additional pressure face 19 is provided on the jacket face of the distributor. This is realized by virtue of the fact that bores 21 and 22 are let into the distributor, which continuously communicate with the pressure line 7 and have their mouths at the pressure faces 19 and 19', respectively. These bores 21 and 22 advantageously lead from a pressure chamber 24 into which the connecting line 16 feeds upstream of the solenoid valve member 15. With this embodiment, a counterpressure field is built up in the region of the pressure faces 19 and 19', which field is disposed essentially diametrically opposite the pressure field 17 associated with the distributor opening. In the exemplary embodiment, two bores 21 and 22 are provided, which are disposed symmetrical to each other with regard to the radial plane in which the distributor opening 8 exits at the jacket face. It is essential as well that the bores 21 and 22 each exit in a region of the distributor jacket face or the inner wall of the housing bore 2 in which the housing bore always completely overlaps the exits of the bores 21 and 22. In this manner, a counterpressure field is disposed diametrically opposite each pressure field 17 so that the distributor is uniformly loaded in an essentially moment-free manner by means of these pressure fields. In the course of this, an optimal centering of the distributor in the housing bore can take place and a constant lubricant film is maintained between the jacket face and housing bore. In the process, an optimal supply of lubricating fuel to the gap between the jacket face 9 of the distributor and the housing bore 2 is achieved.

Instead of the apparatus shown here, in which the distributor opening 8 and pressure faces 19, by means of the distributor axis, are disposed in a common longitudinal plane, naturally an apparatus of this kind can also be provided with only one bore if the load ratios permit it. The exit of this one bore then rests against the radial plane of the exit of the distributor opening, adjoining it in a manner that is as close to axis as possible. In a further modification, as a supplement to the version according to the exemplary embodiment or as a replacement for it, it is also possible to provide a number of bores on the circumference, distributed in a radial plane, in order to achieve a uniform force and pressure action of the distributor, particularly in the high pressure feed phase of the pump piston. By choosing the number of exit bores and the exit face of these bores, an optimizing adaptation of the force balance that acts upon the distributor can be carried out here.

Another effect of this improved bearing is constituted in that leakage losses are reduced or high pressure tightness is increased. In this way, the consequently improved fuel injection pump is suited for producing higher fuel injection pressures which in the end, results in an improved injection with a reduction of emission values and less of a strain on the environment. Also, material pairings that are prone to scoring have less risk of damage with this embodiment.

The improved bearing of a rotating part, the distributor, is shown here in the example of a radial piston distributor pump. The measures provided here, though, can be realized in just as favorable a manner in fuel injection pumps that are embodied differently, such as fuel injection pumps with reciprocating pistons or fuel injection pumps with pistons that reciprocate and are driven to rotate at the same time. With moving parts of this kind, better bearing properties of the moving part can be achieved.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising a rotatingly driven distributor (3) supported in a housing bore (2), a distributor opening (8) discharges at a jacket face (9) of the distributor (3), said distributor opening is periodically supplied with fuel at high pressure via a pressure line (7) and in a course of the rotation of the distributor (3) comes to communicate successively with various injection lines (11), the fuel under high pressure discharges at the circumference of the distributor (3) into the housing bore (2), in order to carry the fuel, pumped at high pressure to the distributor opening (8), and on to one injection valve each, first and second pressure equalization openings (19, 19') as outlets of bores (21, 22) communicate with said pressure line (7) that leads from a high-pressure source to the distributor opening, the first and second pressure equalization openings are located axially above and below the distributor opening (8) on one side of the jacket face (9) of the distributor (3) remote from the distributor opening (8), wherein the first and second pressure equalization openings remain covered constantly by an inner wall of the housing bore (2) in a course of the motion of the distributor (3) and are located in a same axial plane as the distributor opening (8) through the axis of the distributor.

2. A fuel injection pump as set forth in claim 1, in which the bores (21, 22) are located symmetrically to a radial plane of the distributor (3) that passes through the distributor opening (8).

* * * * *